US005687590A

United States Patent [19]

Borroni et al.

[11] Patent Number: 5,687,590

[45] Date of Patent: Nov. 18, 1997

[54] DISTRIBUTION VALVE-MIXING DRAWER ASSEMBLY FOR THE SELECTIVE SUPPLY OF DETERGENTS OR OTHER SUBSTANCES TO THE WASHING DRUM OF A WASHING MACHINE OR THE LIKE

[75] Inventors: Giuseppe Borroni; Stefano Francalanci, both of Varese, Italy

[73] Assignee: Tecnoplastica Prealpina S.p.A., Tradate, Italy

[21] Appl. No.: 562,627

[22] Filed: Nov. 24, 1995

[51] Int. Cl.[6] ..... D06F 39/02

[52] U.S. Cl. ..... 68/17 R

[58] Field of Search ..... 68/17 R; 134/93, 134/99.2; 222/325, 651, 652

[56] References Cited

U.S. PATENT DOCUMENTS

| | | | |
|---|---|---|---|
| 3,127,067 | 3/1964 | Hall et al. | 68/17 R X |
| 5,226,301 | 7/1993 | Rizzetto et al. | 68/17 R |

FOREIGN PATENT DOCUMENTS

| | | |
|---|---|---|
| 0 022 414 | 1/1981 | European Pat. Off. . |
| 1 650 543 | 11/1970 | Germany . |
| 3 913 838 | 10/1990 | Germany . |
| 2 138 451 | 10/1984 | United Kingdom . |

*Primary Examiner*—Philip R. Coe
*Attorney, Agent, or Firm*—Young & Thompson

[57] ABSTRACT

An assembly for the selective supply of detergents or the like to the washing drum of a washing machine comprising a drawer (23) for holding detergents having a fixed body (32) and a mobile portion (33) provided with at least a first and a second compartment (34, 35) for containing a respective detergent, said fixed body (32) having at least a first and a second inlet member (34*a*, 35*a*) for a flow of liquid for removing the detergent from a respective compartment (34, 35) which is then discharged enriched with detergent into the washing drum of the washing machine, and a valve device (38) comprising a collector pipe (39) for collecting the flow of liquid for removing the detergent and at least a first and a second valve element (44, 45) each having a respective bowl (44*a*, 45*a*) leading into said collector pipe (39) and a respective outlet member (44*d*, 45*d*) for emission of a respective flow of liquid towards a corresponding inlet member (34*a*, 35*a*) of the detergent drawer (23). According to the invention each of said outlet members (44*d*, 45*d*) of each valve elements (44, 45)is coupled directly and hermetically to the respective inlet member (34*a*, 34*b*) of the respective compartment (34, 35) of the drawer (23), and in that are provided means (54, 55, 56) for attaching said valve device (38) directly to the fixed body (32) of said drawer (23) for the detergents.

32 Claims, 10 Drawing Sheets

DISTRIBUTION VALVE-MIXING DRAWER ASSEMBLY FOR THE SELECTIVE SUPPLY OF DETERGENTS OR OTHER SUBSTANCES TO THE WASHING DRUM OF A WASHING MACHINE OR THE LIKE

FIELD OF THE INVENTION

The present invention relates to a distribution valve-mixing drawer assembly for the selective supply of detergents or other additives to the washing drum of a washing machine, such as for washing laundry.

BACKGROUND OF THE INVENTION

At present, in order to supply and mix a detergent substance or one of another kind to the washing water used in washing machines, a drawer is used which has a part attached to the frame of the washing machine and a movable part which can be extracted outside of the washing machine for loading detergents or other washing additives.

Generally automatic loading by the washing machine of the washing additive housed inside a respective compartment of the detergent-holder drawer is carried out, at an appropriate moment in a specific washing sequence programmed by a timer, by means of a suitable flow of water, diverted by the supply system of the washing drum towards the required compartment of the detergent-holder drawer. For this purpose, the supply system is connected to an electromagnetically actuated valve device commanded by the timer in order to obtain a suitable flow of water towards a respective compartment of said drawer for housing detergent substances or washing additives.

The loading flow is currently diverted towards the programmed compartment containing the detergent or additive suitable for the phase of washing in progress by using electromagnetically actuated valve devices attached directly to frame of the washing machine and having a number of outlet ways for the flow which can range from one to four.

Usually in the previous cases, the outlets of the solenoid valve are connected to the inlet of the drawer by means of flexible hoses and clamps in plastic or metal.

More particularly, in the event of a valve device with one single way being used, the flow of water is distributed to the various compartments of the detergent-holder drawer by means of a baffle which is moved by a cam located on the shaft of the timer, via a control lever, so as to divert the flow of water towards the compartment programmed.

In the case of a valve device with several outlet ways, each outlet is connected hydraulically to the individual compartment of the drawer by means of a hose in rubber or plastic and related clamps. In this case the timer pilots the coil of the individual ways during the washing cycle, sending the water into each compartment at the appropriate moment.

These devices have overall the following negative aspects.

The use of a baffle and relevant mechanical drive device requires, in order to guarantee proper working of the device, accurate assembly of the mechanism, which can be carried out almost exclusively by hand. This mechanical device also requires awkward and repeated calibrations and setting-up operations of the drive mechanism, which involve the use of a certain number of hours of work at considerable cost.

The use of drawers with a valve device having several outlet ways for the flow (up to four outlet ways) eliminates the problem of the moving parts and setting them up, however the use of clamped connection pipes is proportionally increased, with a rise in cost due both to the excessive use of components and to the excessive assembly times, and moreover, in this case too, with the disadvantage that such assembly of connection pipes and tightening clamps, which requires the insertion of the ends of the connection hoses in rubber or plastic onto the outlets and fittings of the elements to be connected as well as positioning and tightening of the clamp, can be carried out virtually only by hand and cannot therefore be automated.

In these valve devices with several outlet ways used at present, except in the case of the device with only two outlet ways, although all the outlets for transfer of the flow of water discharge on only one side of the valve device, they are not aligned one with the other.

At present in fact, in order to supply a flow of water to the various compartments of the detergent-bolder drawer, distribution valve devices with three outlet ways are used whose transfer outlets are arranged at the top of a triangle and devices with four outlet ways whose transfer outlets are arranged at the top of a rectangle. Considering the fact that detergent-holder drawers are currently produced with inlet fittings for the flows of liquid which are aligned one with the other, as a result producers of washing machines are currently obliged to use the aforementioned connection hoses and relevant clamps in order to connect the outlets of the valve device to the inlet fitting of the detergent-holder drawer.

OBJECT OF THE INVENTION

The object of the present invention is to provide a distribution valve-drawer assembly for selectively dispensing detergents to the washing drum of a washing machine which eliminates the use of flexible pipes and clamp connections between the valve device and the drawer, with a subsequent reduction in related assembling times and costs avoiding also the use of mechanical flow distribution systems, which are complex and awkward to regulate.

Another object of the present invention is that of providing an assembly of the kind referred above which is suitable for automated assembling.

SUMMARY OF THE INVENTION

According to the present invention, an assembly is obtained which avoids the need to use those connections, pipe and clamp, currently used between solenoid valves and drawer, with a consequent reduction in relevant assembling costs and in that of decreasing the time necessary for assembling the assembly being in this way eliminated the operations of inserting the flexible pipes and tighten clamps.

The elimination of the operations of inserting the flexible pipes and tighten clamps by means of a direct coupling of the outlet members of the valve device with the inlet members of the detergent drawer allows an automatic assembling of the assembly.

A reduction in the overall assembling times for the washing machine is also achieved in that the entire assembly comprising the valve device and the detergent drawer can be mounted separately and then supplied to the washing machine manufacturers in an assembled condition. A reduction of the time necessary for mounting the assembly onto the washing machines is in this way achieved in respect to the prior art assemblies.

Moreover the assembly of the present invention forms substantially a single compact part occupying a smaller volume compared to similar traditional assemblies inside washing machines.

The features and advantages of the present invention will in any case be made clearer by reading the following description relating to preferred embodiments of the invention.

BRIEF DESCRIPTION OF DRAWINGS

The description which follows must be read with reference to the accompanying drawings, in which.

DISCLOSURE OF THE PREFERRED EMBODIMENTS

Figure 1:
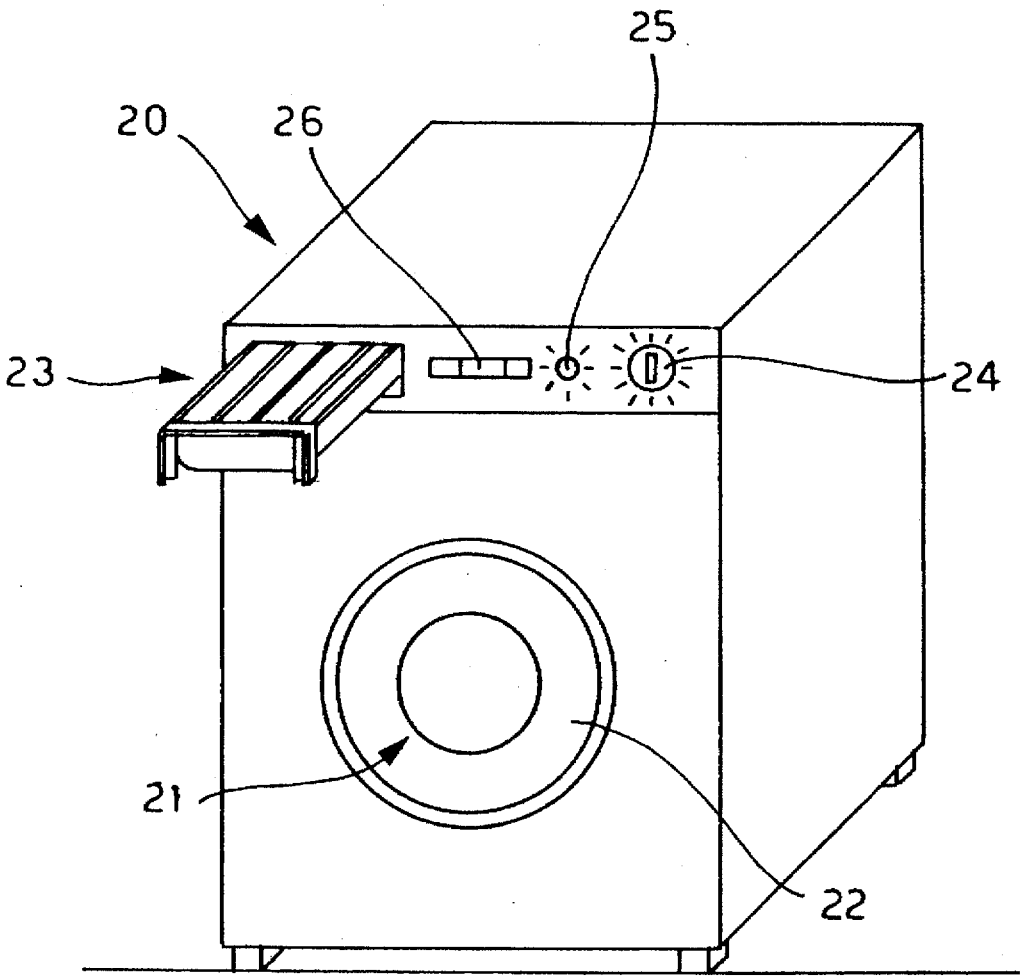
FIG. 1 is a perspective view of a commonly used washing machine, showing the detergent-holder drawer in an extracted position.

FIG. 1 shows a washing machine 20 for domestic use of a wholly standard type. It comprises a front aperture 21 fitted with a closure door 22 for loading laundry inside the laundry-holder drum, a drawer 23 for the selective feed of detergents or other additives to the washing drum, a timer 24 for setting a programmed washing cycle, a knob 25 for controlling the washing temperature and other control push-buttons 26.

As already referred, the present invention sets out to provide a new assembly for the selective supply of detergents or other additives to the washing drum of a washing machine, of the type wherein the valve device selectively sends under control, commanded by the timer 24, a respective flow of water to each of the compartments of the detergent-holder drawer, for taking detergents or additives contained in these compartments.

In the following figures, for convenience of description, the same elements are denoted by the same reference numerals.

A first embodiment of an assembly of the type referred above is shown in FIGS. 2 to 5.

The assembly, denoted as a whole by the reference numeral 30, comprises a drawer for holding the detergent substance 23 which has an external tray or fixed body of the drawer 32, which is attached to the frame of the washing machine, and a mobile portion or actual drawer 33 which can be extracted from the frame of the washing machine for loading detergents and which has four compartments 34, 35, 36, 37 for containing a respective detergent substance or additive of the detergents. For example a first compartment 34 for containing a detergent for the prewash, a second compartment 35 for containing a detergent for actual washing, a third compartment 36 for containing a bleaching agent and a fourth compartment 37 for containing a conditioner.

Each compartment is provided with a respective inlet fitting 34*a*, 35*a*, 36*a*, 37*a* for the flow of liquid for removing the detergent substance and is connected to a sleeve (not shown) for discharging the flow of liquid enriched with the detergent substance towards the washing drum of the washing machine.

Said inlet fittings 34*a*, 35*a*, 36*a*, 36*a* are provided, coplanar and parallel to each other, at one end of the fixed body 32 of the detergent-holder drawer and lead into the compartments of the mobile part of the drawer by means of respective pipes 34*b*, 35*b*, 36*b*, 37*b* and drop holes 34*c*, 35*c*, 36*c*, 37*c*.

The assembly also comprises a valve device 38 having a collector pipe 39 wherein the flow of liquid which has been taken from the system of delivery to the drum of the washing machine is collected. Said collector 39 has an inlet mouth 40 for the flow of water connected to a coupling 41 by means of a ring nut 42 which has an end portion 43 suitable for inserting a feed pipe branching off from the pipe for feeding washing water to the washing drum of the machine.

According to the invention the valve device 38 comprises a valve element for feeding the respective flow of water to each compartment of the drawer. That is to say, as shown in the figures, the valve element 44 for the compartment 34, the valve element 45 for the compartment 35, the valve element 46 for the compartment 36 and the valve element 47 for the compartment 37.

The valve elements have respective bowls 44*a*, 45*a*, 46*a*, 47*a* connected through suitable apertures 44*b*, 45*b*, 46*b*, 47*b* to said collector pipe 39 and through respective ports 44*c*, 45*c*, 46*c*, 47*c* with respective emission outlets 44*d*, 45*d*, 46*d*, 47*d*.

Said apertures 44*b*, 45*b*, 46*b*, 47*b* are opened or closed by means of diaphragm gates 44*e*, 45*e*, 46*e*, 47*e* driven by corresponding actuation coils or windings 44*f*, 45*f*, 46*f*, 47*f* provided around corresponding hollow stems 44*g*, 45*g*, 46*g*, 47*g* which house corresponding ferromagnetic cores 44*h*, 45*h*, 46*h*, 47*h* internally.

Said ferromagnetic cores 44*h*, 45*h*, 46*h*, 47*h* are made to slide inside the respective hollow stems 44*g*, 45*g*, 46*g*, 47*g*, in an opening condition of the respective valve, under the magnetic action of the respective electric windings 44*f*, 45*f*, 46*f*, 47*f* which are fed, under the control of the programme timer 24 of the washing machine, with suitable electric currents via the connection terminals 44*i*, 45*i*, 46*i*, 47*i*. In a normal condition, with the windings de-energized, the gates 44*e*, 45*e*, 46*e*, 47*e* of the valve elements 44, 45, 46, 47 are driven into a closed condition by means of respective compression springs 44*l*,45*l*, 46*l*,47*l* housed inside the hollow stems 44*g*, 45*g*, 46*g*, 47*g*, which act on the ferromagnetic cores 44h, 45h, 46h, 47h at the ends of the latter opposite the ends of attachment to said diaphragm gates 44e, 45e, 46e, 47e.

Each ferromagnetic core, in conditions of de-energized winding, goes to rest upon a plastic insert 44m, 45m, 46m, 47m, inserted in the diaphragm gate. This insert is guided inside the emission inlet and has longitudinal guide ribs, distanced angularly to allow the passage between the latter of the flow of water for removing and loading detergent or additive.

According to the invention provision is made for said outlets 44d, 45d, 46d, 47d of the valve elements 44, 45, 46, 47 to be coupled directly to the respective inlet fittings 34a, 35a, 36a, 36a of the compartments 34, 35, 36, 37 of the drawer.

In a preferred manner, as shown in this first embodiment, cylindrical outlets 44d, 45d, 46d, 47d have an external diameter and cylindrical inlet fittings 34a, 35a, 36a, 37a of the compartments of the drawer 23 have an internal diameter which is diameter of the external diameter of said cylindrical outlets 44d, 45d, 46d, 47d. The cylindrical outlets 44d, 45d, 46d, 47d are arranged coaxially inside said cylindrical inlet fittings 34a, 35a, 36a, 37a of the drawer 23.

Obviously a connection between the outlets of the valve device and the fittings of the drawer wherein said outlets have an internal diameter and said fittings of the compartments of the drawers have an external diameter which is larger than the internal diameter of said outlets, in such a way that the fittings can be inserted in said outlets, is also foreseeable for the present invention.

Moreover provision is made for attaching directly said valve device in a disengageable manner to said fixed body of the detergent drawer.

For this purpose the valve device has a support plate 48 integral with the valve elements and with the collector and provided with end tabs 49, 50 having through holes 51, 52 and having a further hole 53 in a central position. Corresponding clamping screws 54, 55, 56 pass through said holes 51, 52, 53 and are inserted in corresponding blind holes 57, 58, 59 provided in cylindrical extensions 60, 61,62 of the tray or fixed body 32 of said drawer. As can be seen from the figures, said screws have a widened head for restraining the plate 48 and the valve device 38 supported by it to said fixed body 32 of the drawer.

Nevertheless it must be understood that the use of other connection parts which allow the valve device to be disengaged from said drawer can also be foreseen for the present invention.

Figure 2:
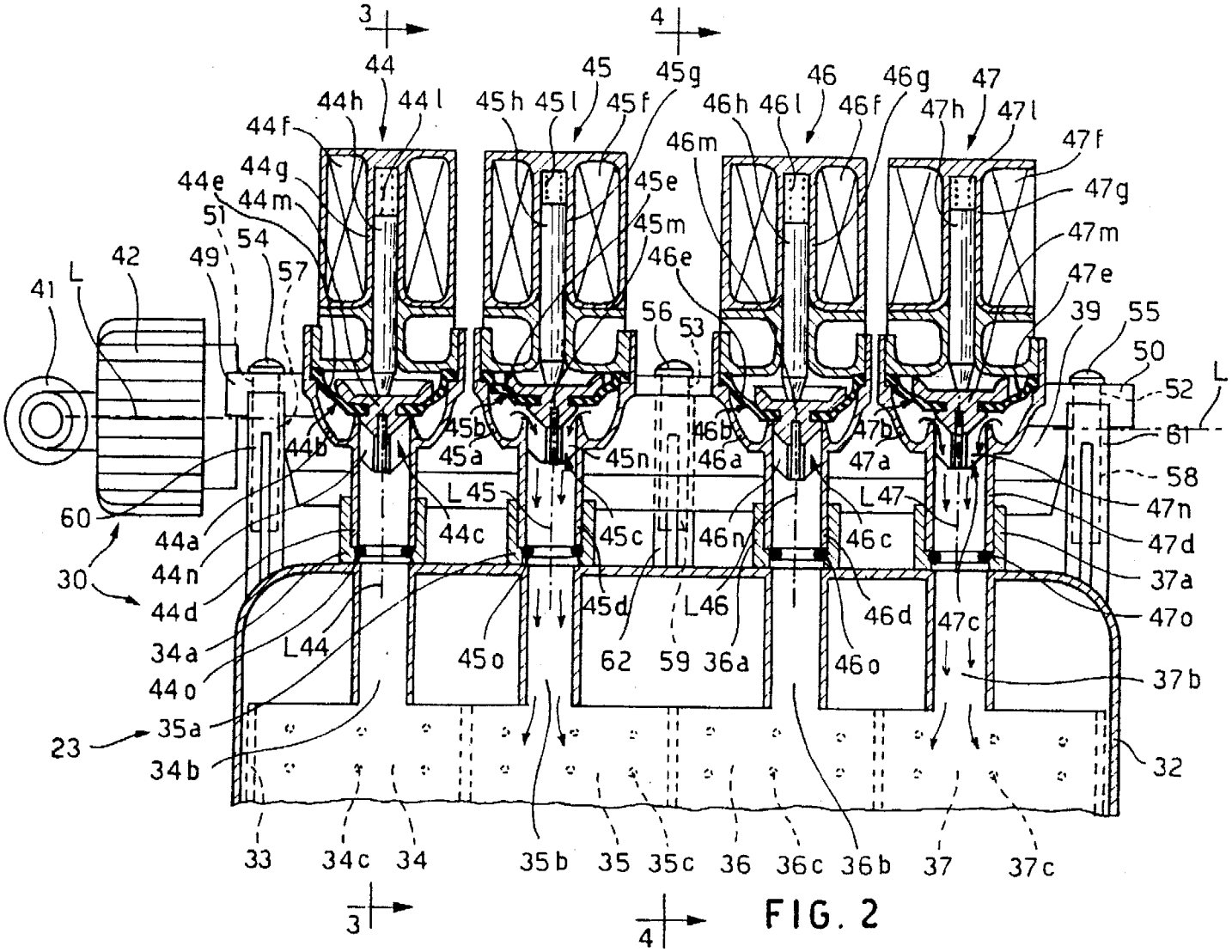
FIG. 2 is a top view of a first preferred embodiment of the distribution valve-mixing drawer assembly according to the present invention, sectioned along line 2—2 of FIG. 5.
Figure 3:
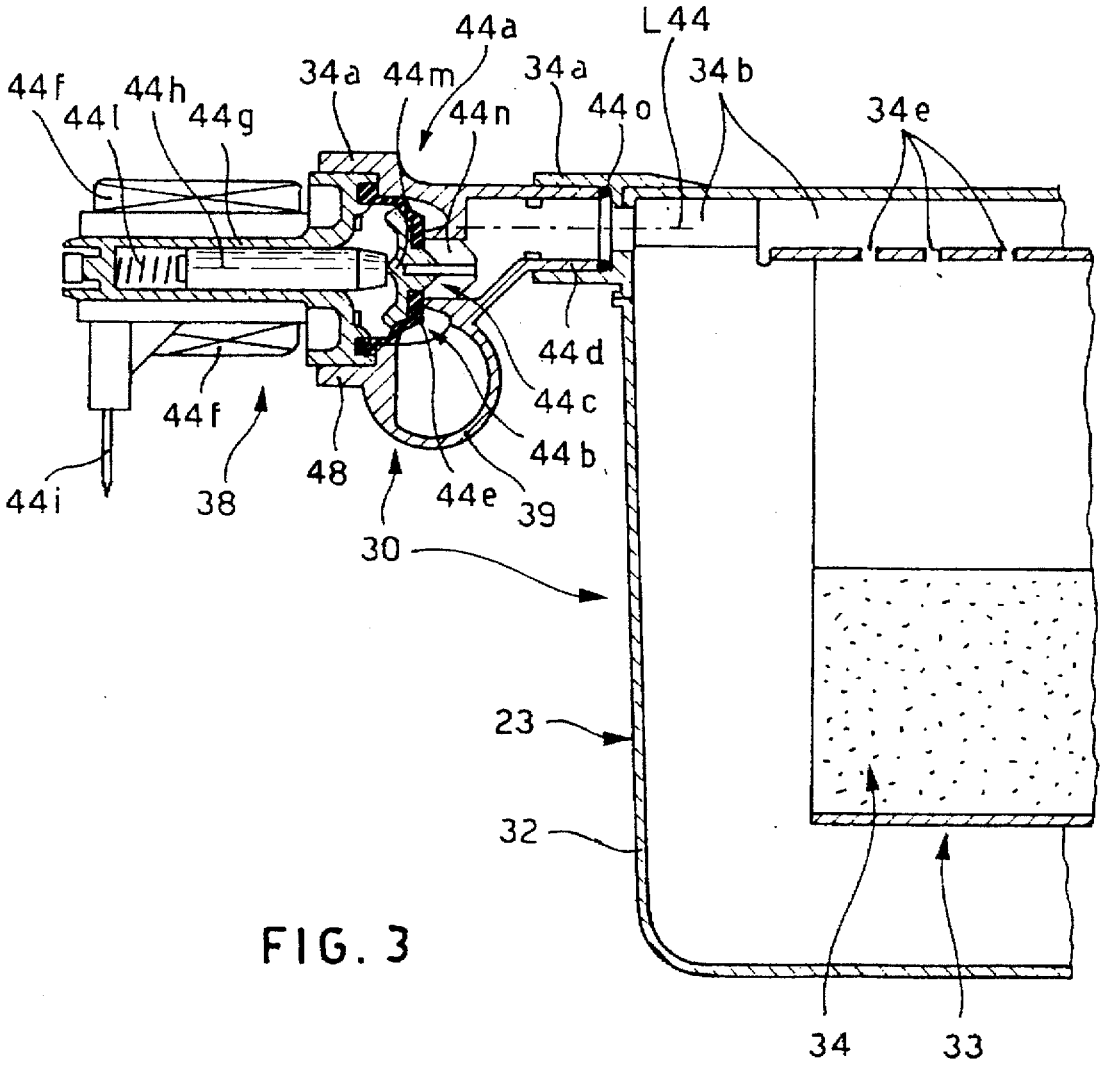
FIGS. 3 and 3A are side views of a detail of FIG. 2 sectioned along line 3—3 of FIG. 2, corresponding respectively to a closed condition of the valve element and to an opened condition of the valve element.
Figure 3A:
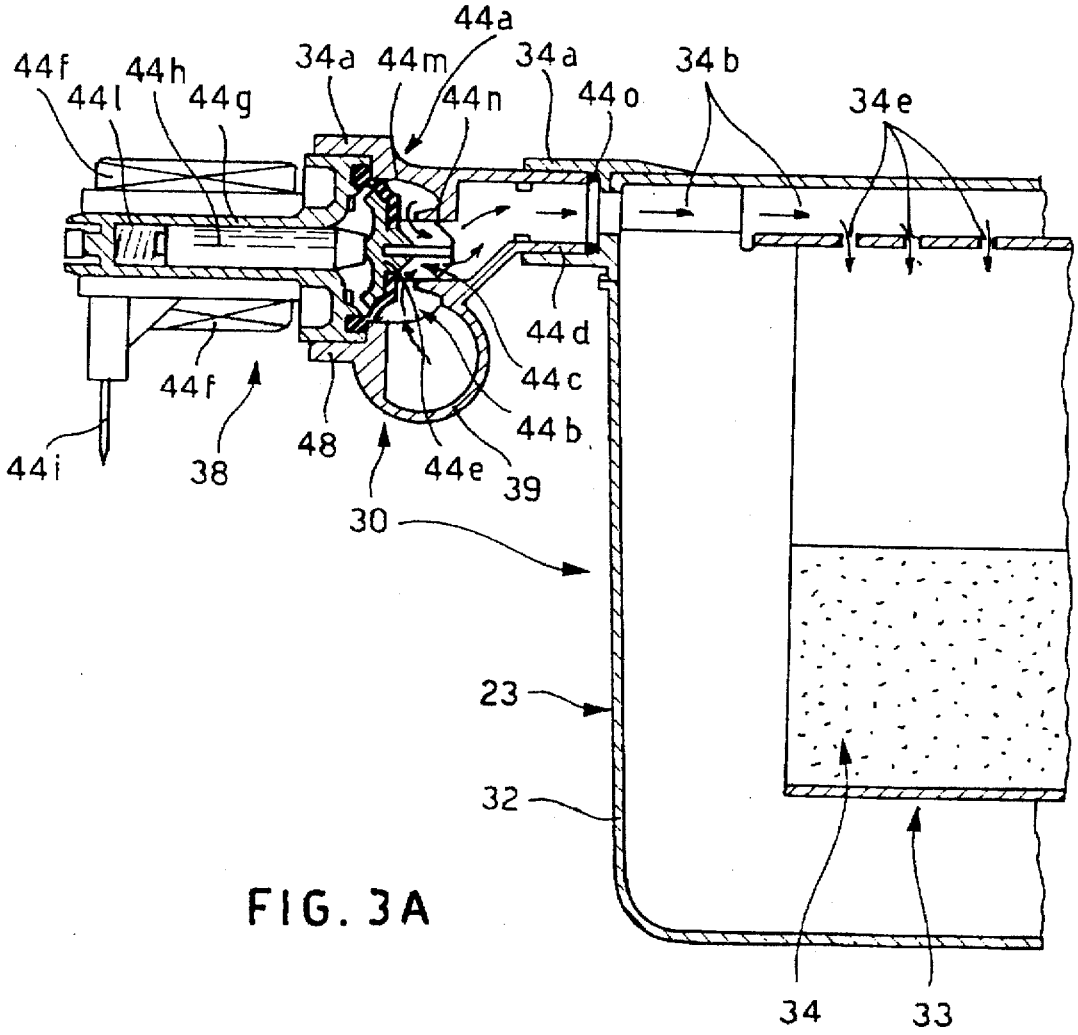
Figure 4:
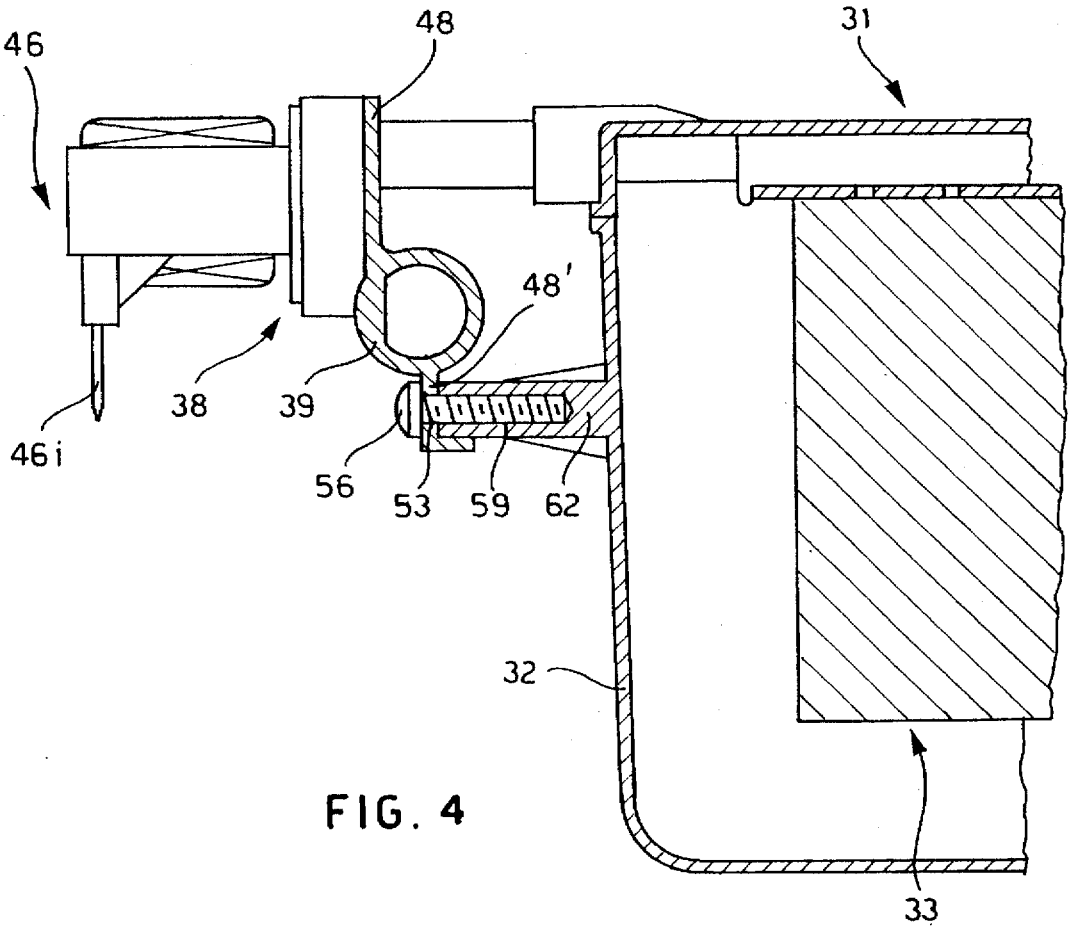
FIG. 4 is a side view of a detail of FIG. 2 sectioned along line 4—4 of FIG. 2.

As it is shown in FIG. 2 references L44, L45, L46, L47 denote the respective axis of the cylindrical outlets 44d, 45d, 46d, 47d of valve elements 44, 45, 46, 47.

Figure 5:
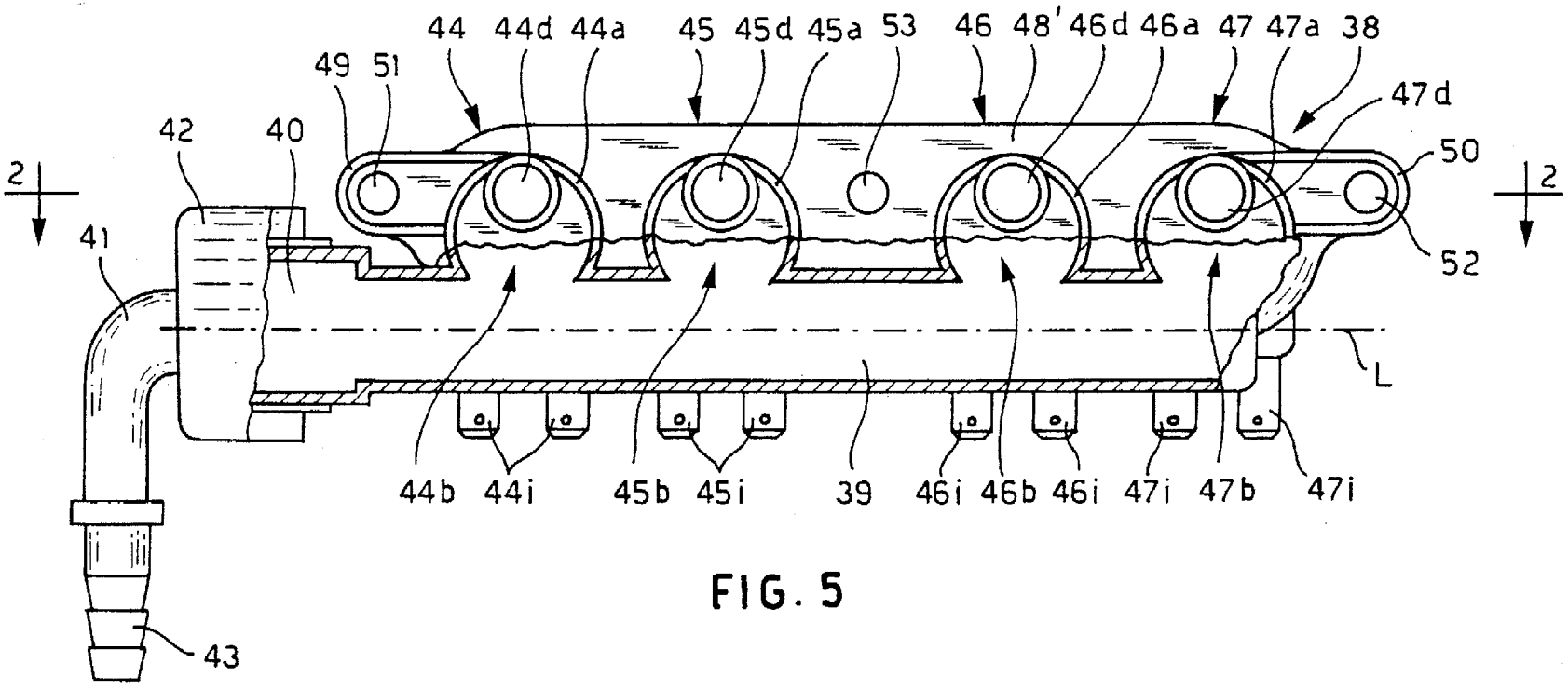
FIG. 5 is a front view in a partial section plane of the distribution valve alone of the first preferred embodiment of the invention.

As it is clear particularly from FIG. 5, said valve elements 44, 45, 46, 47 are arranged on one side of said collector pipe 39. Said outlets 44d, 45d, 46d, 47d extend coplanar and parallel one to the other so that they can be coupled to said cylindrical inlet members 34a, 35a, 36a, 36a of the drawer 23 by means of a simple approaching action between said valve device 38 and said drawer 23 along a direction parallel to said cylindrical outlet members 44d, 45d, 46d, 47d of the valve device 38 and to said cylindrical inlet members 34a, 35a, 36a, 37a of the drawer 23.

Said cylindrical collector pipe 39 extends with its longitudinal axis L (better shown in FIG. 5) perpendicular to the axis of said emission outlets 44d, 45d, 46d, 47d underneath the plane defined by these axis and with the aperture 40, for the feeding of water into the collector, which is provided at a longitudinal end of the collector 39 itself. In this way the valve device 38 has a compact configuration which occupies a small volume inside the casing of the washing machine.

As it is clear from the figures, a ring in a flexible material is arranged between each outlet of the valve device and the corresponding fitting of the compartment of the drawer for hermetic sealing.

In this first embodiment said seal rings 44o, 45o, 46o, 47o are arranged between the front edge of the respective outlet and an internal annular housing of the corresponding fitting of the relevant compartment.

As it is clear from the figures according to the present invention, the screws 54, 55, 56 for clamping said valve device 38 to said fixed body of the drawer 32 are screwed, for clamping, parallel to the direction of coupling of said outlets 44d, 45d, 46d, 47d of the valve elements 44, 45, 46, 47 of the valve device 38 with said inlet fittings 34a, 35a, 36a, 37a of the compartments 34, 35, 36, 37 of the drawer and the overall reciprocal coupling between the fixed body of the drawer and the flow distribution valve device occurs with elements situated on opposite facing sides of the same.

In this way the number of manoeuvres required for mounting the assembly is considerably simplified and restricted. It is in fact sufficient to insert reciprocally the outlets 44d, 45d, 46d, 47d and the fittings 34a, 35a, 36a, 36a and screw in the same direction the clamping screws 54, 55, 56. The procedure for mounting the device can thus be easily automated.

Figure 7:
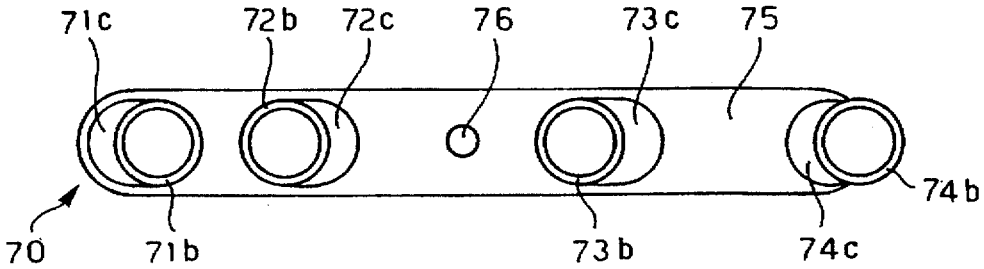
FIG. 7 is a front view of the adapter device of FIG. 6.
Figure 6:
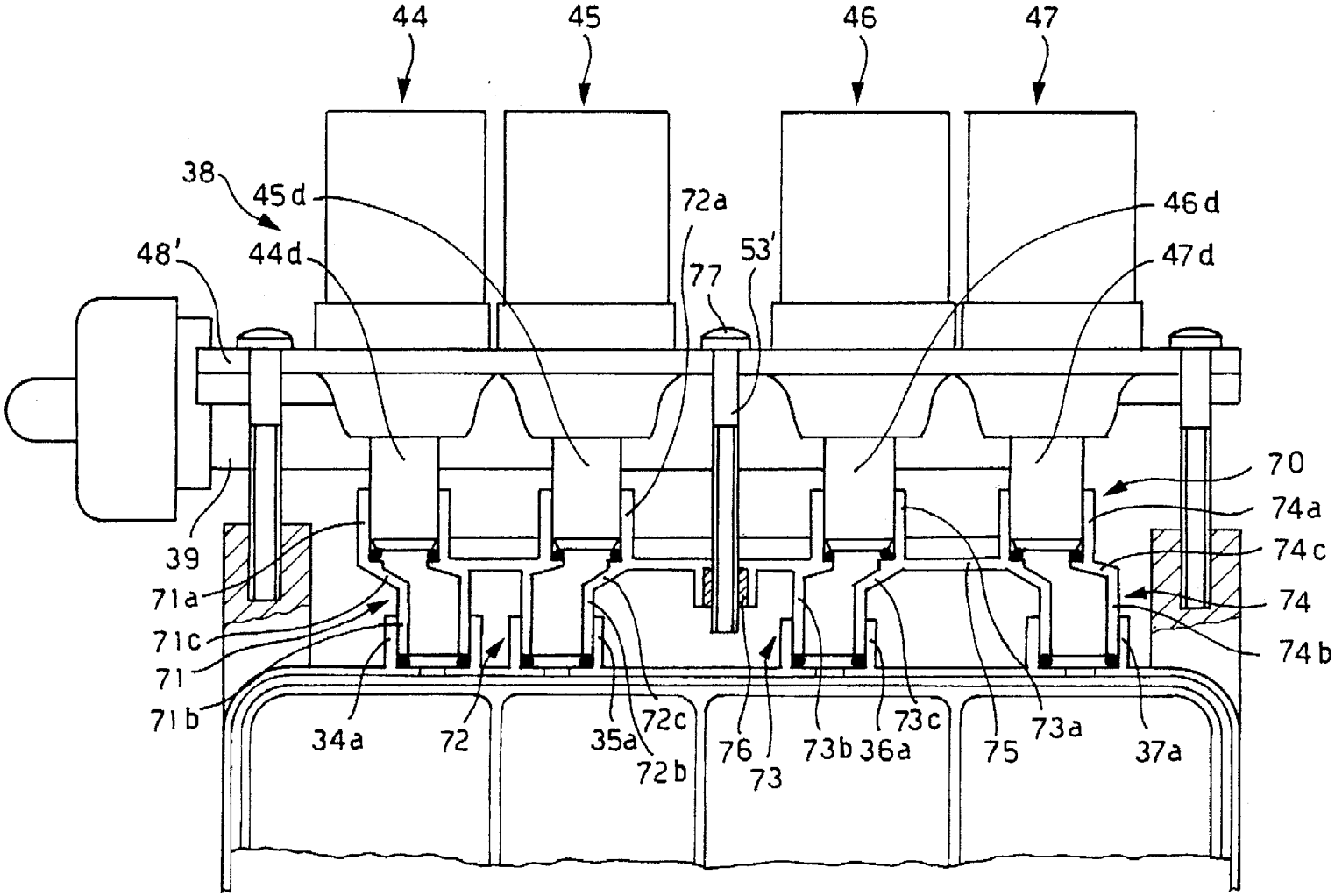
FIG. 6 is a sectioned top view, similar to the view of FIG. 1, of a second preferred embodiment of the assembly of the present invention, showing an adapter device.

According to a further feature of the invention shown in FIGS. 6 and 7, provision is made to equip the present assembly with an adapter element 70 such as to allow adaptation of the valve device to detergent-holder drawers having a different arrangement of the inlet fittings for the flows of loading liquids.

Said adapter element 70 comprises pipes 71, 72, 73, 74 for diverting said flow of water, each having a respective inlet mouthpiece 71a, 72a, 73a, 74a and a respective outlet mouthpiece 71b, 72b, 73b, 74b, which can be coupled respectively with the outlets 44d, 45d, 46d, 47d and the inlet fittings in the compartments 34a, 35a, 36a, 37a.

As it is clear from FIG. 6, in this preferred embodiment the seal rings are provided between the outlets 44d, 45d, 46d, 47d of the valve elements and the inlet mouths 71a, 72a, 73a, 74a in said pipes 71,72, 73, 74 for diverting the flow and between the inlet fittings 34a, 35a, 36a, 36a in the compartments of the drawer and the outlet ends of the same flow diversion pipes. More specifically, said seal rings are placed at the front edge of the outlets 44d, 45d, 46d, 47d and at the inner striking part of the inlet fittings 34a, 35a, 36a, 37a in the compartments.

The adapter comprises a plate 75 for supporting the flow diversion pipes 71, 72, 73, 74; said support plate 75 has a central hole 76 for the passage of a screw 77 for attaching the valve device 38 to the adapter element 70 which is screwed into a hole 53' provided in a central position in the plate 48 for supporting the valve device 38. The adapter 70 is thus attached to said valve device 38 in a disengageable manner. Similarly to what was shown previously between the valve device and the drawer, further screws and respective holes are provided to the side of the screw 77 and hole 76 for attaching the valve device to the fixed body of the drawer.

Said flow diversion pipes 71, 72, 73, 74 have, as is clear from the figures, intermediate tilted sections 71c, 72c, 73c, 74c, while the end inlet mouthpieces 71a, 72a, 73a, 74a and outlet mouthpieces 71*b*, 72*b*, 73*b*, 74*b* are maintained parallel to the directions of insertion of the outlets 44*d*, 45*d*, 46*d*, 47*d* of the valve elements and of the inlet fittings 35*a*, 36*a*, 37*a* in the compartments of the drawer, as well as parallel to the direction of screwing insertion of the clamping screws.

Figure 8:
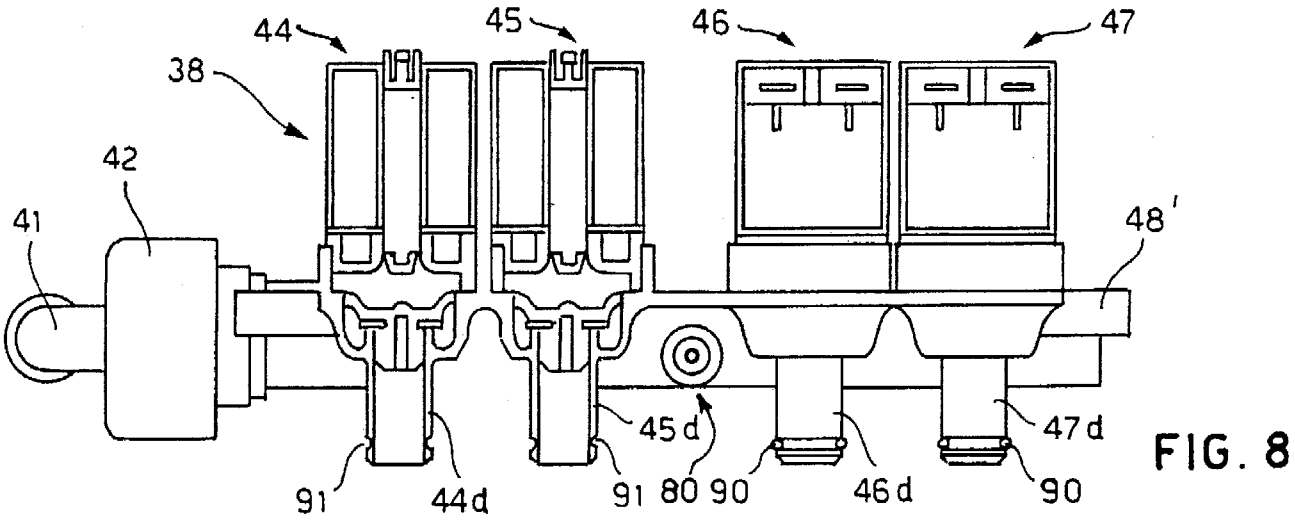
FIG. 8 is a partially sectioned top view of a third preferred embodiment of the assembly of the present invention.
Figure 9:
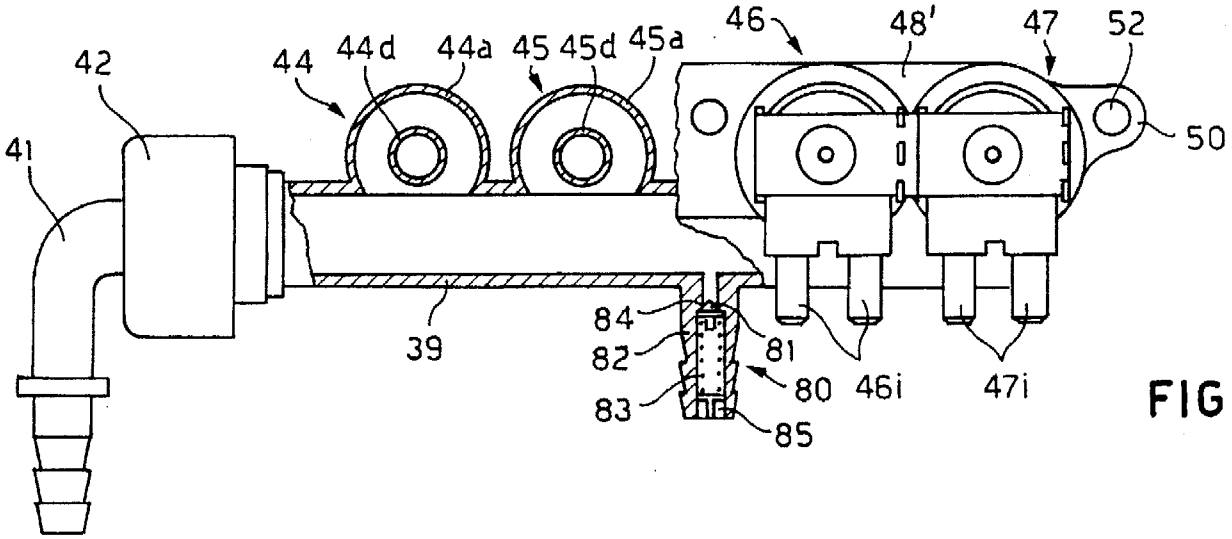
FIG. 9 is a partially sectioned rear view of the third preferred embodiment of the present invention.

As shown in FIGS. 8 and 9, according to a third preferred embodiment, the valve device of the present invention comprises a safety valve 80 for draining water from the inside of said collector pipe 39 on reaching a predetermined safety limit pressure inside the pipe itself.

Said safety valve 80 comprises a gate element 81 housed inside a short pipe 82 turned downwards perpendicular to the outlets of the valve device and leading into the interior of the collector pipe 39 of the valve. Said gate 81 is pushed to close by a spring 83 against a suitable annular seat 84 provided inside the pipe 82. Said spring 83 is returned on a ring nut 85 screwed inside the pipe itself. The spring 83 is chosen so that when the pressure inside the collector 39 exceeds a certain pressure which can be hazardous for the other elements of the valve assembly, it compresses, allowing the backward movement of the gate 81 of the valve which opens at the water discharge port until the pressure inside the collector returns to more acceptable levels.

In this embodiment of FIGS. 8 and 9 a different arrangement of the seal rings is also shown. It can be seen in FIG. 8 that said seal rings 90 are housed in respective grooves 91 of the outlets, which, as shown in FIG. 8, are formed at a certain distance from the front edge of said outlet. Said rings 90 are suitable for being restrained between said annular grooves 91 of the respective outlets and the internal cylindrical surfaces of said inlet fittings (not shown in FIG. 8) in the compartments of the drawer. Obviously for the present invention, an arrangement of the seal rings similar to this one may also be adopted for the connection between the outlets of the valve device and the respective mouthpieces of the adapter element and between the fittings of the drawer and the respective outlets of the same adapter element.

Figure 10:
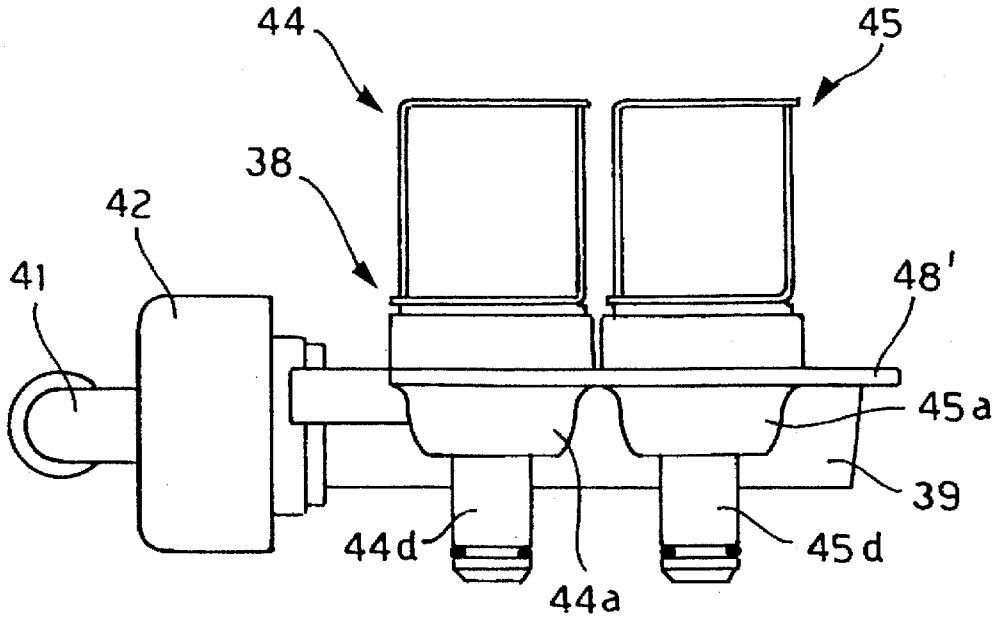
FIG. 10 is a top view of a fourth preferred embodiment of the present invention.
Figure 11:
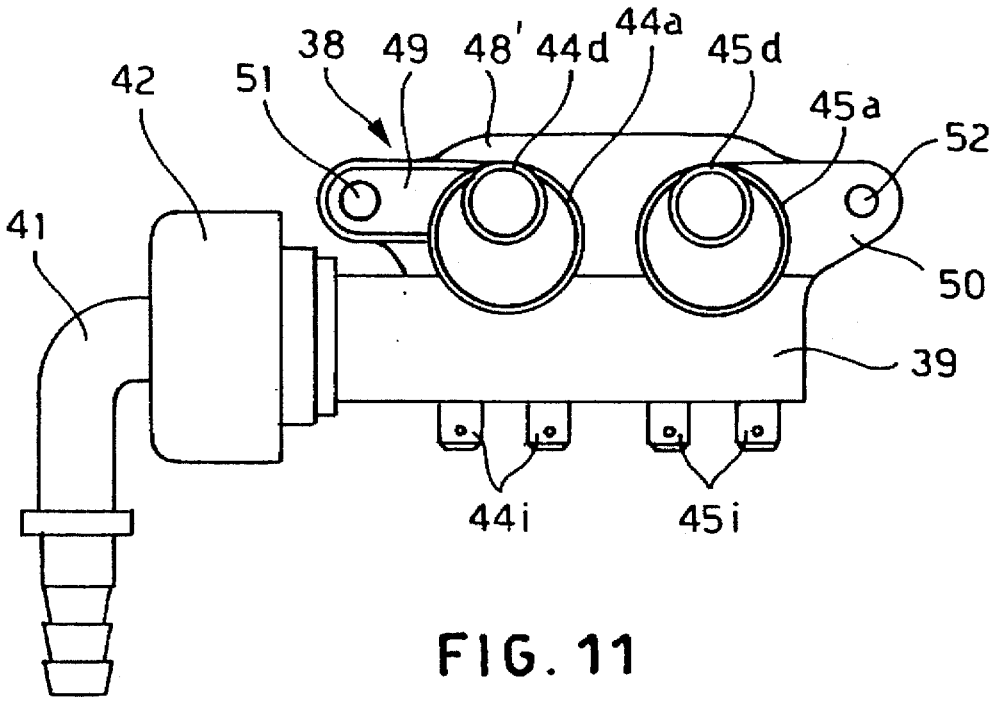
FIG. 11 is a front view of the fourth preferred embodiment of the present invention.
Figure 12:
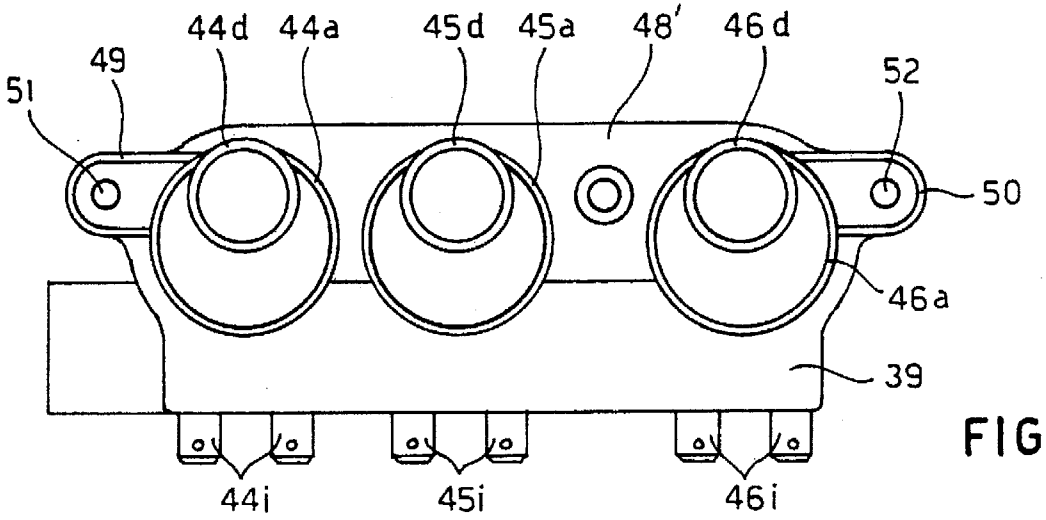
FIG. 12 is a front view of a fifth preferred embodiment of the present invention.
Figure 13:
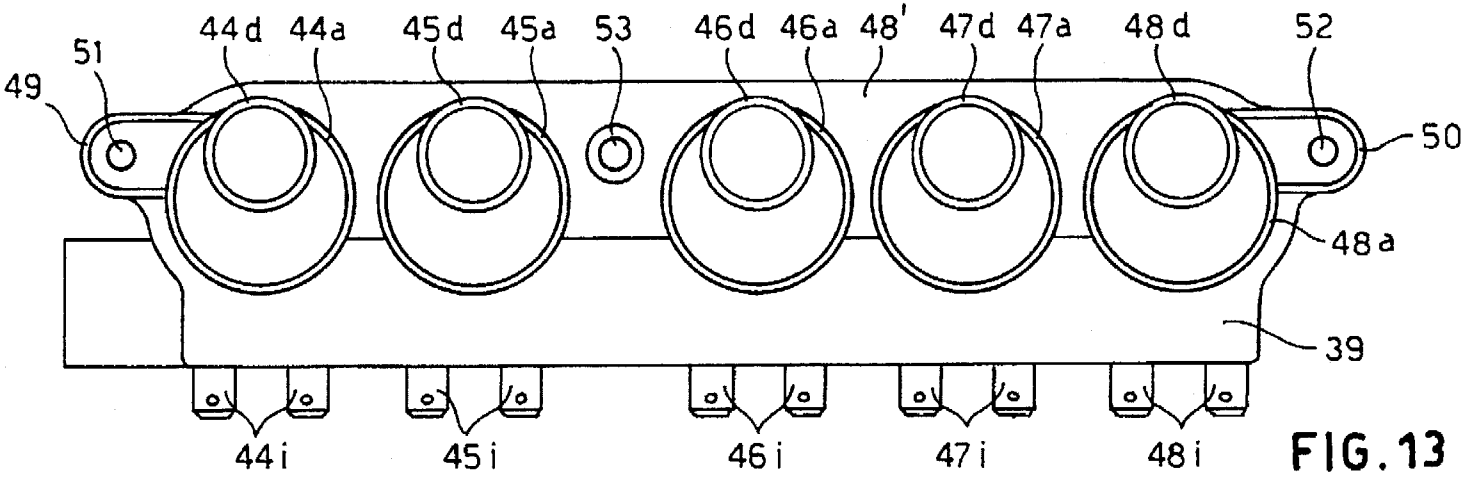
FIG. 13 is a front view of a sixth preferred embodiment of the present invention.

The remaining figures show further preferred embodiments of the invention. The figures refer to: FIGS. 10 and 11 to a valve device with only two outlet ways, FIG. 12 to a valve device with three outlet ways and FIG. 13 to a valve device with five outlet ways.

In these preferred embodiments the reference numerals denote elements which have the same features of the embodiment with four ways described in detail previously. Therefore the description of the solution with four outlet ways applies thereto and it is considered wholly superfluous to provide further detailed descriptions for them.

It should finally be underlined that, in all the preferred embodiments, the valve body of the valve device, comprising the collector pipe, the bowls of the valve elements and the support plate, is preferably made in one single, compact part in plastic.

What is claimed is:

1. An assembly for the selective supply of detergents to the washing drum of a washing machine, comprising a drawer (23) for holding detergents having a fixed body (32) and a mobile portion (33) provided with at least a first and a second compartment (34, 35) for containing a respective detergent, said fixed body (32) having at least a first and a second inlet member (34*a*, 35*a*) for a flow of liquid for removing the detergent from a respective compartment (34, 35) which is then discharged enriched with detergent into the washing drum of the washing machine, and a valve device (38) comprising a collector pipe (39) for collecting the flow of liquid for removing the detergent and at least a first and a second valve element (44, 45) each having a respective bowl (44*a*, 45*a*) leading into said collector pipe (39) and a respective outlet member (44*d*, 45*d*) for emission of a respective flow of liquid towards a corresponding inlet member (34*a*, 35*a*) of the detergent drawer (23); wherein each of said outlet members (44*d*, 45*d*) of each valve elements (44, 45) is coupled directly and hermetically to the respective inlet member (34*a*, 35*a*) of the respective compartment (34, 35) of the drawer (23), and wherein are provided means (54, 55, 56) for attaching said valve device (38) directly to the fixed body (32) of said drawer (23) for the detergents.

2. An assembly according to claim 1, in which the drawer (23) for holding the detergents is provided with at least a third (36) compartment for containing a respective detergent, in which the fixed body of the drawer (23) further comprises at least a third (36*a*) inlet member, said first, second, and third inlet members (34*a*, 35*a*, 36*a*) being arranged coplanar and parallel to each other, and in which said valve device (38) further comprises at least a third (46) valve element having a respective outlet member, (46*d*) for emission of a respective flow of liquid towards said third inlet member (36*a*) of the drawer (23); wherein said first, second, and third outlet members (44*d*, 45*d*, 46*d*) are arranged on the same side of the valve device (38) coplanar and parallel to each other for coupling to respective ones of said first, second, and third inlet members (34*a*, 35*a*, 36*a*) by means of a simple approaching action between said valve device (38) and said drawer (23) along a direction parallel to said outlet members (44*d*, 45*d*, 46*d*).

3. An assembly according to claim 2, wherein said collector pipe (39) has a substantially elongated cylindrical shape whose axis extends perpendicular to an axis of said outlet members (44*d*, 45*d*, 46*d*).

4. An assembly according to claim 1, wherein said means (54, 55, 56) for attaching is for removably attaching said valve device (38) directly to the fixed body (32).

5. An assembly according to claim 1, wherein between each of said outlet members (44*d*, 45*d*) and the corresponding one of said inlet members (34*a*, 35*a*) at least one ring (44*o*, 45*o*, 90) of a flexible material is arranged for hermetic sealing.

6. An assembly according to claim 5 wherein rings (44*o*, 45*o*) are arranged between a front edge of the respective one of said outlet members (44*d*, 45*d*) and an internal annular housing of the corresponding one of said inlet members (34*a*, 35*a*).

7. An assembly according to claim 5, wherein said outlet members each comprise an external peripheral groove (91) and wherein said rings (90) are housed in said groove (91) between respective ones of said outlet members (44*d*, 45*d*) and the respective internal surfaces of said inlet members (34*a*, 35*a*).

8. An assembly according to claim 1, wherein said outlet members (44*d*, 45) have an external diameter and said inlet members (34*a*, 35*a*) have an internal diameter greater than the external diameter of said outlet members (44*d*, 45*d*), said outlet members (44*d*, 45*d*) being arranged coaxially inside respective ones of said inlet members (34*a*, 35*a*).

9. An assembly according to claim 1, wherein said collector pipe (39) has a safety valve (80) for discharging the liquid from inside said collector pipe (39) on reaching a predetermined safety limit pressure inside the same collector pipe (39).

10. An assembly according to claim 1, further comprising an adapter element (70) comprising at least first and second pipes (71, 72) for angularly redirecting said flow of liquid, each of said first and second pipes having a respective inlet mouthpiece (71*a*, 72*a*) and respective outlet mouthpiece (71*b*, 72*b*) for being coupled to respective ones of said outlet members (44*b*, 45*b*) and said inlet members (34*a*, 35*a*).

11. An assembly according to claim 10, wherein said adapter element (70) has a support and connection plate (75) for said first and second pipes (71, 72).

12. An assembly according to claim 11, wherein are provided means (77) for connecting disengageably said support and conection plate (75) to said valve device (38).

13. An assembly for the selective supply of detergents to the washing drum of a washing machine, comprising a drawer (23) for holding detergents having at least a first and a second compartment (34, 35) for containing a respective detergent and a first and a second inlet member (34*a*, 35*a*) each provided for conveying a flow of liquid into a respective compartment (34, 35) for removing the detergent therefrom, and valve means comprising at least a first and a second outlet member (44*d*, 45*d*) for emission of a respective flow of liquid towards a corresponding detergent compartment (34, 35) of the drawer (23); wherein each of said outlet members (44*d*, 45*d*) of the valve means is coupled directly to the respective inlet member (34*a*, 35*a*) of the respective compartment (34, 35) of the drawer (23).

14. An assembly according to claim 13, further comprising means (54, 55, 56) for attaching said valve means (38) directly to said drawer (23).

15. An assembly for the selective supply of detergents to the washing drum of a washing machine, comprising a drawer (23) for holding detergents having at least a first and a second compartment (34, 35) for containing a respective detergent and a first and a second inlet member (34*a*, 35*a*) each provided for conveying a flow of liquid into a respective compartment (34, 35) for removing the detergent therefrom, and valve means comprising at least a first and a second outlet member (44*d*, 45*d*) for emission of a respective flow of liquid towards a corresponding detergent compartment (34, 35) of the drawer (23); and means (54, 55, 56) for attaching said valve means (38) directly to said drawer (23).

16. An assembly according to claim 15, wherein said means (54, 55, 56) for direct attachment are means for attaching removably said valve means (38) to said drawer (23).

17. An assembly according to claim 16, wherein said means (54, 55, 56) for direct and removable attachment comprise screw means (54, 55, 56) protruding parallel to said outlet members (44*d*, 45*d*) of the valve means (38) and to said inlet members (34*a*, 35*a*).

18. An assembly according to claim 13, wherein said valve means are in the form of a valve device (38) comprising a collector pipe (39) for collecting the flow of liquid for removing the detergent and at least a first and a second valve element (44, 45) each having a respective bowl (44*a*, 45*a*) leading into said collector pipe (39).

19. An assembly according to claim 18, wherein the drawer (23) further comprises at least a third (36) compartment for containing a respective detergent and at least a third (36*a*) inlet member, said first, second, and third inlet members (34*a*, 35*a*, 36*a*) being arranged coplanar and parallel to each other, in that said valve device (38) further comprise at least a third (46) valve element having a respective outlet member (46*d*) for emission of a respective flow of liquid towards a corresponding inlet member (36*a*) of the drawer (23); and in that said first, second, and third outlet members (44*d*, 45*d*, 46*d*) are arranged on the same side of the valve device (38) coplanar and parallel to each other for coupling directly to respective ones of said first, second, and third inlet members (34*a*, 35*a*, 36*a*) by means of an approaching action between said valve device (38) and said drawer (23) along a direction parallel to said outlet members (44*d*, 45*d*, 46*d*).

20. An assembly according to claim 19, wherein said collector pipe (39) has a substantially elongated cylindrical shape whose axis extends perpendicular to an axis of said outlet members (44*d*, 45*d*, 46*d*).

21. An assembly according to claim 13, wherein said outlet members (44*d*, 45*d*) have an external diameter and said inlet members (34*a*, 35*a*) of the compartments (34, 35) of the drawer (23) have an internal diameter greater than the external diameter of said outlet members (44*d*, 45*d*), said outlet members (44*d*, 45*d*) being arranged coaxially inside inlet members (34*a*, 35*a*).

22. An assembly according to claim 13, wherein between each of said outlet members (44*d*, 45*d*) and the corresponding one of said inlet members (34*a*, 35*a*) at least one ring (44*o*, 45*o*, 90) in a flexible material is arranged for hermetic sealing.

23. An assembly according to claim 22, wherein said rings (44*o*, 45*o*) are arranged between a front edge of the respective one of said outlet members (44*d*, 45*d*) and an internal annular housing of the corresponding one of said inlet members (34*a*, 35*a*).

24. An assembly according to claim 22, wherein said outlet members each comprise an external annular groove (91) and wherein said rings (90) are housed in said groove (91) between respective ones of said outlet members (44*d*, 45*d*) and the respective internal surfaces of said inlet members (34*a*, 35*a*).

25. An assembly according to claim 13, wherein said collector pipe (39) has a safety valve (80) for discharging the liquid from inside said collector pipe (39) on reaching a predetermined safety limit pressure inside the same collector pipe (39).

26. An assembly for the selective supply of detergents to the washing drum of a washing machine, comprising a drawer (23) for holding detergents having at least a first and a second compartment (34, 35) for containing a respective detergent and a first and a second inlet member (34*a*, 35*a*) each provided for conveying a flow of liquid into a respective compartment (34, 35) for removing the detergent therefrom, and valve means comprising at least a first and a second outlet member (44*d*, 45*d*) for emission of a respective flow of liquid towards a corresponding detergent compartment (34, 35) of the drawer (23); wherein the assembly comprises an adapter element (70) comprising at least a first and a second pipe (71, 72) for angularly redirecting said flow of liquid, each of said first and second pipes having a respective inlet mouthpiece (71*a*, 72*a*) and respective outlet mouthpiece (71*b*, 72*b*) for coupling directly and respectively to ones of said outlet members and to ones of said inlet members (34*a*, 35*a*).

27. An assembly according to claim 26, further comprising means (77) for connecting disengageably said valve means to said adapter element (70).

28. An assembly according to claim 27, wherein said adapter element (70) has a support and connection body (75) for said first and second pipes (71, 72), and in that said means (77) for connecting disengageably said valve device (38) to said adapter element (70) with said support body (75).

29. An assembly according to claim 27, wherein said means (77) for connecting comprise screw means (77) protruding parallel to said outlet members (44*d*, 45*d*).

30. An assembly according to claim 26, further comprising means (54, 55, 56) for attaching said valve means (38) directly to said drawer (23), in that said means (54, 55, 56) for direct attachment are means for attaching removably said valve means (38) to said drawer (23) and in that said means (54, 55, 56) for direct and removable attachment comprise screw means (54, 55, 56) protruding parallel to outlet members (44*d*, 45*d*).

31. An assembly according to claim 26, wherein said first and second pipes (71, 72) have intermediate tilted sections (71*c*, 72*c*) while said inlet mouthpieces (71*a*, 72*a*) and said outlet mouthpieces (71*b*, 72*b*) are maintained parallel to respective axes of said outlet members (44*d*, 45*d*) and of said inlet members (34*a*, 35*a*.

32. An assembly according to claim 26, further comprising seal rings between corresponding ones of said outlet members (44*d*, 45*d*) and said inlet mouthpieces (71*a*, 72*a*), wherein said seal rings are placed between a front edge of said outlet members (44*d*, 45*d*) and an inner abutment part of said inlet mouthpieces (71*a*, 72*a*); and in that further seal rings are provided between corresponding ones of said inlet members (34*a*, 35*a*) and said outlet mouthpieces (71*b*, 72*b*), wherein said further seal rings are placed between a front edge of said outlet mouthpieces (71*b*, 72*b*) and an inner abutment part of said inlet members (34*a*, 35*a*).

* * * * *